US011279383B2

(12) United States Patent
Li et al.

(10) Patent No.: US 11,279,383 B2
(45) Date of Patent: Mar. 22, 2022

(54) SLEEPING CAR COMPARTMENT AND SLEEPING CAR

(71) Applicant: CRRC TANGSHAN CO., LTD., Tangshan (CN)

(72) Inventors: Xiayan Li, Tangshan (CN); Lei Zhang, Tangshan (CN); Guoyan Gao, Tangshan (CN); Liwei Shen, Tangshan (CN); Baolin Yu, Tangshan (CN); Chenhui Liu, Tangshan (CN)

(73) Assignee: CRRC TANGSHAN CO., LTD., Tangshan (CN)

( * ) Notice: Subject to any disclaimer, the term of this patent is extended or adjusted under 35 U.S.C. 154(b) by 276 days.

(21) Appl. No.: 16/700,785

(22) Filed: Dec. 2, 2019

(65) Prior Publication Data

US 2020/0122750 A1 Apr. 23, 2020

Related U.S. Application Data

(63) Continuation of application No. PCT/CN2017/115544, filed on Dec. 12, 2017.

(30) Foreign Application Priority Data

Jun. 2, 2017 (CN) ..... 201710409131.9

(51) Int. Cl.
*B61D 17/04* (2006.01)
*B61D 1/02* (2006.01)
*B61D 19/00* (2006.01)

(52) U.S. Cl.
CPC ..... *B61D 1/02* (2013.01); *B61D 17/048* (2013.01); *B61D 19/003* (2013.01)

(58) Field of Classification Search
CPC ..... B61D 1/02; B61D 17/048; B61D 17/06; B61D 17/08; B61D 19/00; B61D 19/003;
(Continued)

(56) References Cited

U.S. PATENT DOCUMENTS 6,857,834 B2 * 2/2005 Nelson ..... B60P 3/205 410/129
8,899,534 B2 * 12/2014 Chi ..... F16M 11/10 248/124.2

(Continued)

FOREIGN PATENT DOCUMENTS

CN 2516412 Y 10/2002
CN 101386305 A 3/2009

(Continued)

OTHER PUBLICATIONS

The EESR of application No. 17911439.2.

(Continued)

*Primary Examiner* — Zachary L Kuhfuss
*Assistant Examiner* — Cheng Lin
(74) *Attorney, Agent, or Firm* — J.C. Patents

(57) ABSTRACT

A sleeper train carriage and a sleeper train, a compartment (100) and an aisle (101) is provided within the sleeper train carriage, and a partition wall is provided between the compartment (100) and the aisle (101). The partition wall includes a compartment-side partition wall (1) and an aisle-side partition wall (2). The aisle-side partition wall (2) includes a fixed plate (21) and a movable plate (22) which are arranged in a vertical direction, the movable plate (22) is located above the fixed plate (21), an upper end of the movable plate (22) is fixedly connected to one end of a top plate of the aisle (3), the other end of the top plate of the aisle (3) is detachably connected to the side wall (4) of the train body, and a lower end of the movable plate (22) is hinged to the train body.

16 Claims, 6 Drawing Sheets

(58) Field of Classification Search
CPC ..... B61D 19/004; B61D 19/008; B61D 1/00; B61D 1/06; B61D 1/08; B61D 37/003; B64D 37/003; B64D 11/0604; B64D 11/0023; B64D 11/003; B64D 11/04; B60R 7/00; B60R 7/02; B62D 65/14; F16C 11/04
See application file for complete search history.

(56) References Cited

U.S. PATENT DOCUMENTS

| | | | | |
|---|---|---|---|---|
| 9,308,996 | B2 * | 4/2016 | Schneider | B64D 11/003 |
| 9,878,791 | B2 * | 1/2018 | Kammerer | B64D 11/003 |
| 2018/0258673 | A1 * | 9/2018 | Schoerkhuber | E05C 17/50 |

FOREIGN PATENT DOCUMENTS

| | | | | | |
|---|---|---|---|---|---|
| CN | 201856766 | U | | 6/2011 | |
| CN | 201941786 | U | | 8/2011 | |
| CN | 102190000 | A | | 9/2011 | |
| CN | 202624242 | U | * | 12/2012 | |
| CN | 202624242 | U | | 12/2012 | |
| CN | 204355058 | U | | 5/2015 | |
| CN | 204511225 | U | | 7/2015 | |
| CN | 204801799 | U | * | 11/2015 | B61D 17/08 |
| CN | 204801799 | U | | 11/2015 | |
| CN | 106218651 | A | | 12/2016 | |
| CN | 107215344 | A | | 9/2017 | |
| DE | 4300717 | A1 | | 7/1994 | |
| DE | 19910115 | A1 | * | 9/2000 | B61D 17/08 |
| JP | H11278257 | A | | 10/1999 | |
| JP | 2004-338649 | A | | 12/2004 | |
| JP | 2015-174507 | A | | 10/2015 | |
| JP | 2017030437 | A | | 2/2017 | |
| WO | WO2011003733 | A1 | | 1/2011 | |

OTHER PUBLICATIONS

The International Search Report of corresponding International application No. PCT/CN2017/115544, dated Mar. 9, 2018.
The Chinese First Examination Report, including the Search Report of corresponding Chinese application No. 201710409131.9, dated Aug. 22, 2018.

* cited by examiner

SLEEPING CAR COMPARTMENT AND SLEEPING CAR

CROSS-REFERENCE TO RELATED APPLICATION

The present application is a continuation of International Application No. PCT/CN2017/115544, filed on Dec. 2, 2017, which claims priority to Chinese Patent Application No. 201710409131.9 with the disclosure name "Sleeper Train Carriage and Sleeper Train", filed to China National Intellectual Property Administration on Jun. 2, 2017. The disclosures of the aforementioned applications are hereby incorporated by reference in its entirety.

TECHNICAL FIELD

The present disclosure relates to railway vehicle manufacturing technology, and in particular, to the sleeper train carriage and the sleeper train.

BACKGROUND

FIG. 1 is a schematic diagram of a structure of the sleeper train carriage in the prior art. As shown in FIG. 1, the sleeper train carriage includes sleeper compartments 100 and an aisle 101 outside of the compartment, where the compartments and the aisle are separated by a partition wall. The partition wall has two layers including a compartment-side partition wall 102 and an aisle-side partition wall 103, and a track for sliding the compartment sliding door is provided between the two layers, to ensure the normal opening and closing of the compartment sliding door.

FIG. 2 is an A-A sectional view of FIG. 1; and FIG. 3 is a B-B sectional view of FIG. 1. Please refer to FIGS. 2-3, in the prior art, the aisle-side partition wall 103 includes a first partition wall plate 1031 located above the compartment sliding door 1001 and a second partition wall plate 1032 located on both sides of the compartment sliding door 1001 and the first partition wall plate 1031. An upper portion of the second partition wall plate 1032 is fixedly connected to the top plate of aisle 1033 and a lower portion thereof is fixedly connected to the floor of the train. A connector 1034 is also provided at a position of the second partition wall plate 1032 adjacent to the first partition wall plate 1031, one end of the connector 1034 is fixed to the second partition wall plate 1032, and the other end thereof extends to the lower portion of the first partition wall plate 1031. The top plate of aisle 1033 is provided with a mounting groove 1035 in an area above the compartment sliding door 1001, an upper portion of the first partition wall plate 1031 is inserted into the mounting groove 1035, and a lower portion of the first partition wall plate 1031 is connected to the connector 1034 by fastening screws. In daily maintenance, the track for compartment sliding door 1001 can be maintained after detaching the first partition wall plate 1031.

However, in the prior art, only the first partition wall plate 1031 can be detached when performing daily maintenance on the partition wall. Therefore, only the track in the range of the first partition wall plate 1031 can be maintained, while the track for compartment sliding door provided in the second partition wall plate 1032 cannot be maintained, resulting in inconvenience of maintenance.

SUMMARY

In order to overcome the above-mentioned shortcomings in the prior art, an object of the present disclosure is to provide a sleeper train carriage and a sleeper train, the sleeper train carriage of the present disclosure has an aisle-side partition wall that can be easily opened, so that the daily maintenance of the track for compartment sliding door can be conveniently performed.

The present disclosure provides a sleeper train carriage which includes a side wall extending along a length direction of a train body and end walls arranged at a front end and a rear end of the side wall. The side wall and the end walls jointly form a carriage body for accommodating passengers; a compartment and an aisle are provided within the carriage body, and a partition wall is provided between the compartment and the aisle. The partition wall includes a compartment-side partition wall and an aisle-side partition wall. The aisle-side partition wall includes a fixed plate and a movable plate which are arranged in a vertical direction, the movable plate is located above the fixed plate, an upper end of the movable plate is fixedly connected to one end of a top plate of aisle, the other end of the top plate of aisle is detachably connected to the side wall of the train body, and a lower end of the movable plate is hinged to the train body, so that the movable plate and the top plate of aisle rotate together around a hinged point.

The present disclosure also provides a sleeper train which includes the above mentioned sleeper train carriage.

In the sleeper train carriage and the sleeper train provided by the present embodiment, the partition wall is set as the compartment-side partition wall and the aisle-side partition wall, and the aisle-side partition wall includes the fixed plate and the movable plate which are arranged in the vertical direction, the movable plate is located above the fixed plate, the upper end of the movable plate is fixedly connected to one end of the top plate of aisle, the other end of the top plate of aisle is detachably connected to the side wall of the train body, and the lower end of the movable plate is hinged to the train body, so that the movable plate and the top plate of aisle can rotate together around the hinged point, and during daily maintenance, the top plate of aisle and the movable plate, which are fixed integrally, can be rotated to expose the track for compartment sliding door between the compartment-side partition wall and the aisle-side partition wall, so that the daily maintenance of the track for compartment sliding door can be performed above the fixed plate, and thus the daily maintenance is greatly facilitated.

BRIEF DESCRIPTION OF THE DRAWINGS

In order to explain the technical solutions in the embodiments of the present disclosure or in the prior art more clearly, the drawings needed to be used in the description of the embodiments or the prior art will be briefly introduced below. Obviously, the drawings in the following description are some embodiments of the present disclosure. For those of ordinary skill in the art, other drawings can also be obtained based on these drawings without creative efforts.

DESCRIPTION OF REFERENCE NUMERALS

| | |
|---|---|
| 1-compartment-side partition wall; | 2-aisle-side partition wall; |
| 3-top plate of aisle; | 4-side wall of train body; |
| 5-fixing bracket; | 6-rotating shaft; |
| 7-rubber sealing strip; | 8-reinforcing rib; |
| 21-fixed plate; | 22-movable plate; |
| 31-lock body; | 32-lock tongue; |
| 33-mounting hole; | 34-sealing strip; |
| 41-clamping element; | 100-compartment; |
| 101-aisle; | 211-groove; |
| 221-rotating shaft fixing portion; | 222-rotating shaft connection portion; |
| 411-clamping groove; | 412-lamp holder mounting frame; |
| 102-compartment-side partition wall (prior art); | |
| 103-aisle-side partition wall (prior art); | |
| 1001-compartment sliding door; | 1031-first partition wall plate; |
| 1032-second partition wall plate; | 1033-top plate of aisle (the prior art); |
| 1034-connector; | 1035-mounting groove. |

Description of Embodiments

In order to make the objectives, technical solutions, and advantages of the embodiments of the present disclosure clearer, the technical solutions in the embodiments of the present disclosure will be described clearly and completely in combination with the drawings in the embodiments of the present disclosure. Obviously, the described embodiments are part of the embodiments of the present disclosure, but not all embodiments. Based on the embodiments of the present disclosure, all other embodiments obtained by a person of ordinary skill in the art without making creative efforts fall within the protection scope of the present disclosure. The embodiments and features in the following embodiments can be combined with each other as long as there's no conflict.

Figure 1:
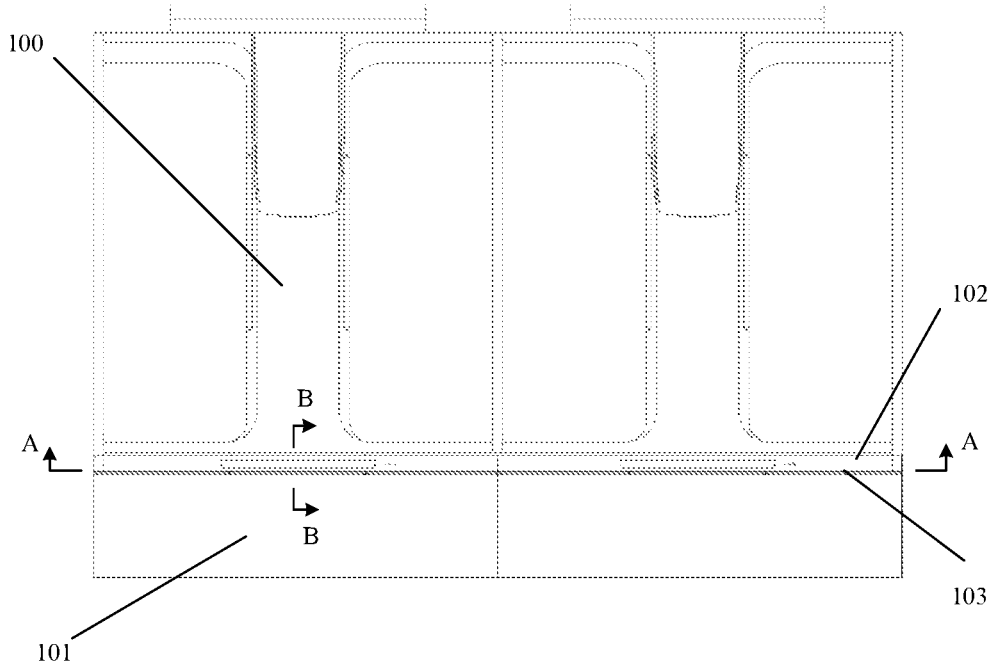
FIG. 1 (Prior Art)
FIG. 1 is a schematic diagram of a structure of the sleeper train carriage in the prior art.
Figure 2:
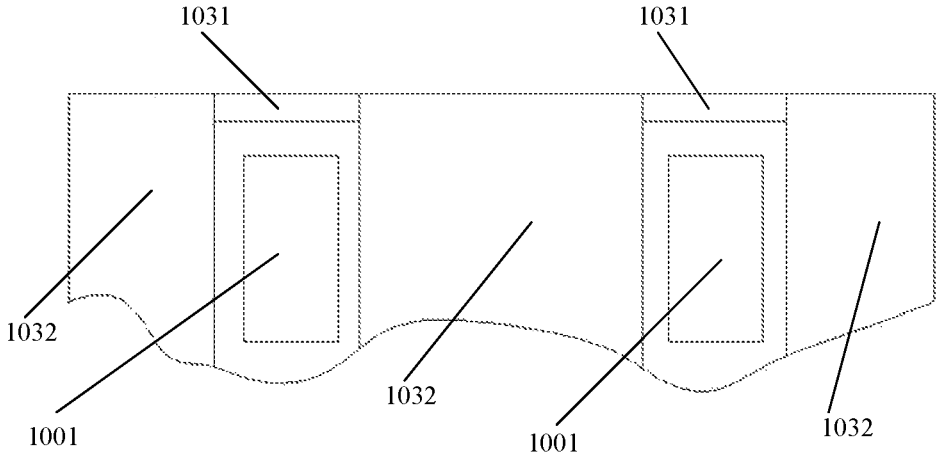
FIG. 2 (Prior Art)
FIG. 2 is an A-A sectional view of FIG. 1.
Figure 3:
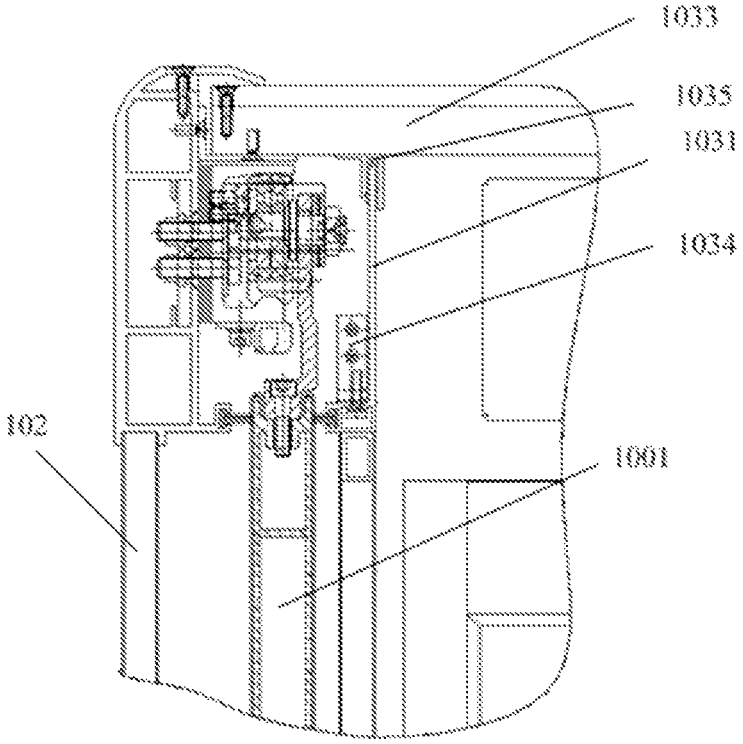
FIG. 3 (Prior Art)
FIG. 3 is a B-B sectional view of FIG. 1.
Figure 4:
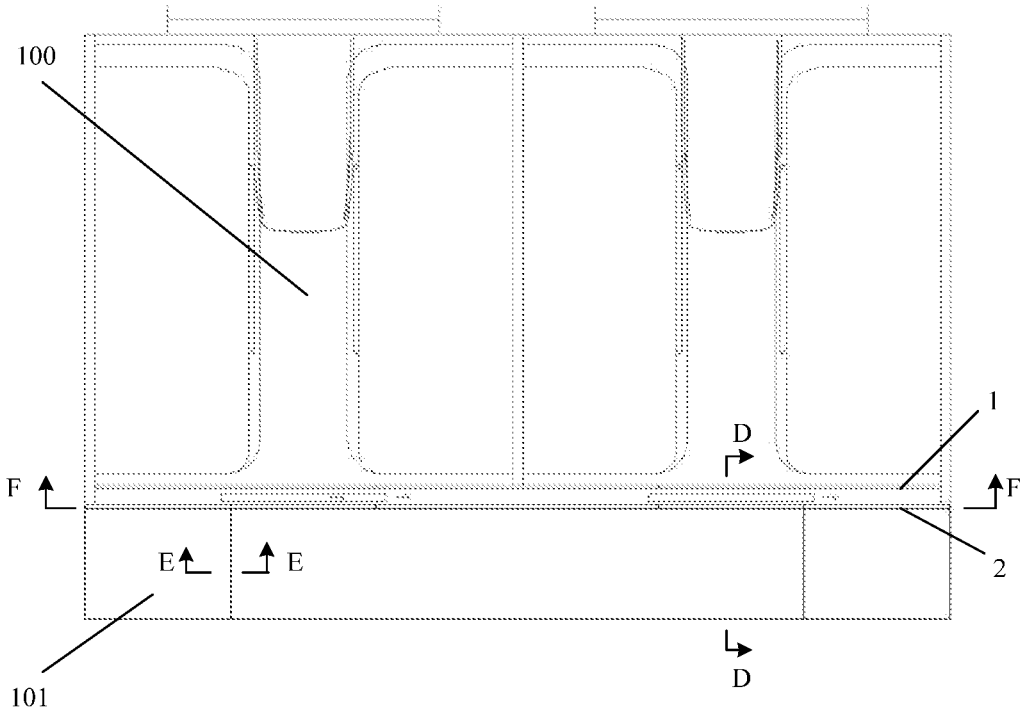
FIG. 4 is a schematic diagram of a structure of the sleeper train carriage provided in the present embodiment.
Figure 5:
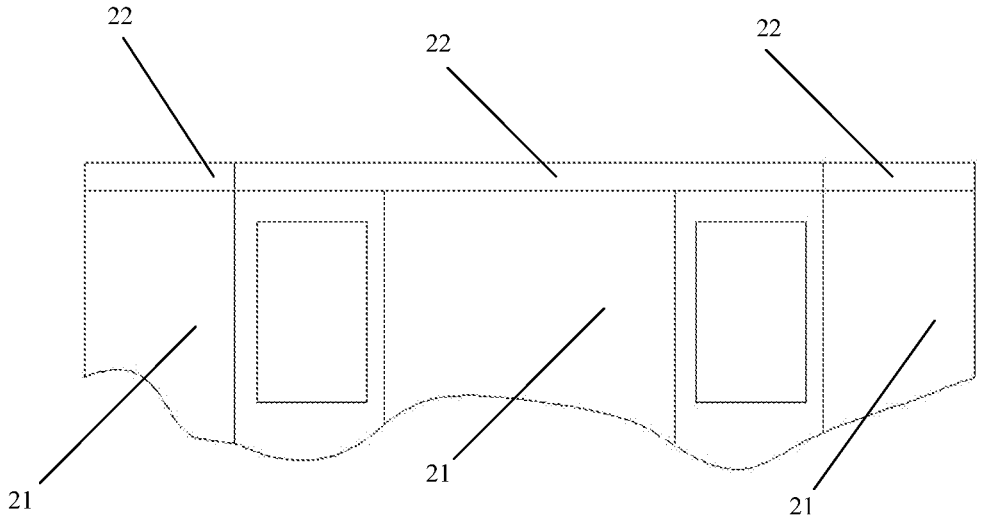
FIG. 5 is an F-F sectional view of FIG. 4.
Figure 6:
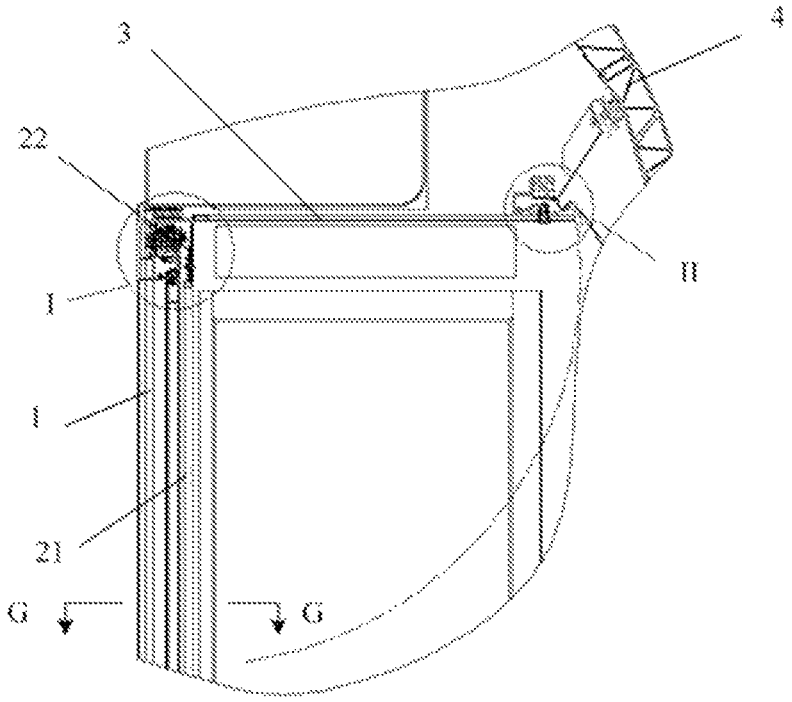
FIG. 6 is a D-D sectional view of FIG. 4.

FIG. 4 is a schematic diagram of a structure of the sleeper train carriage provided in the present embodiment; FIG. 5 is an F-F sectional view of FIG. 4; and FIG. 6 is a D-D sectional view of FIG. 4. Please refer to FIGS. 4-6, an embodiment of the present disclosure provides a sleeper train carriage, which includes a side wall extending along a length direction of a train body and end walls arranged at a front end and a rear end of the side wall, and the side wall and the end walls jointly form a carriage body for accommodating passengers. A compartment 100 and an aisle 101 are provided within the carriage body, and a partition wall is provided between the compartment 100 and the aisle 101. The partition wall includes a compartment-side partition wall 1 and an aisle-side partition wall 2, the aisle-side partition wall 2 includes a fixed plate 21 and a movable plate 22 which are arranged in a vertical direction, and the movable plate 22 is located above the fixed plate 21. An upper end of the movable plate 22 is fixedly connected to one end of a top plate of the aisle 3, the other end of the top plate of the aisle 3 is detachably connected to the side wall 4 of the train body, and a lower end of the movable plate 22 is hinged to the train body, so that the movable plate 22 and the top plate of the aisle 3 can rotate together around a hinged point.

Specifically, the above-mentioned sleeper train carriage is a cuboid-shaped carriage body which is jointly formed by the side wall set along the length direction of the train body and the end walls arranged at both ends of the side wall, and doors can be provided at both ends of the side wall for passengers to get on and off. In order to explain the solutions of the present disclosure more clearly, FIG. 4 of the present disclosure shows the sleeper train carriage having two compartments in length direction. As shown in FIG. 4, the body of the sleeper train carriage can be divided into two big areas which include the sleeper compartment 100 and the aisle 101. The aisle 101 and the compartment 100 are separated by the partition wall, which not only ensures quiet travel conditions in the compartment, but also acts as a carrier for a track for compartment sliding door. The partition wall generally includes the compartment-side partition wall (that is, a partition wall near the side of the compartment) 1 and the aisle-side partition wall (that is, a partition wall near the side of the aisle) 2. The track for compartment sliding door is generally provided between the compartment-side partition wall 1 and the aisle-side partition wall 2, so that the compartment sliding door can be opened in the direction shown by the arrow in FIG. 4 during daily use.

In order to make the daily maintenance of the compartment sliding door more convenient, the present embodiment changes the structure of the partition wall which uses an integral design in the prior art. As shown in FIG. 5, in the present embodiment, the aisle-side partition wall 2 includes a fixed plate 21 and a movable plate 22 which are arranged in the vertical direction. A bottom end of the fixed plate 21 is fixedly connected to the train body, and a connection manner thereof may be a bolt connection manner in the prior art. The movable plate 22 is located above the fixed plate 21 and, in order to enable the movable plate 22 to be conveniently opened for daily maintenance of the compartment sliding door, the movable plate 22 can be moved relative to the fixed plate 21. Specifically, as shown in FIG. 6, in the present embodiment, an upper end of the movable plate 22 is fixedly connected to one end of the top plate of the aisle 3 so that the two form an L-shape as a whole. Preferably, in order to ensure a clean appearance in the carriage, the movable plate 22 and the top plate of the aisle 3 can be integrally formed, so that the connection gap is not exposed in the aisle, thereby making the carriage clean and beautiful. The lower end of the movable plate 22 is hinged to the train body, and the other end of the top plate of the aisle 3 is detachably connected to the side wall 4 of the train body, so that during daily maintenance, the movable plate 22 and the top plate of the aisle 3 can rotate together around the hinged point (that is, rotating along the trajectory shown by the dotted line in FIG. 6) by disassembling one end of the top plate of aisle 3 connected to the side wall 4 of the train body, so that the compartment sliding door can be maintained above the fixed plate 21.

In the sleeper train carriage provided by the present embodiment, the partition wall is set as the compartment-side partition wall 1 and the aisle-side partition wall 2, and the aisle-side partition wall 2 includes the fixed plate 21 and the movable plate 22 which are arranged in the vertical direction, the movable plate 22 is located above the fixed plate 21, the upper end of the movable plate 22 is fixedly connected to one end of the top plate of aisle 3, the other end of the top plate of aisle 3 is detachably connected to the side wall 4 of the train body, and the lower end of the movable plate 22 is hinged to the train body, so that the movable plate 22 and the top plate of aisle 3 can rotate together around the hinged point, and during daily maintenance, the top plate of aisle 3 and the movable plate 22, which are fixed integrally, can be rotated to expose the track for compartment sliding door between the compartment-side partition wall 1 and the aisle-side partition wall 2, so that the daily maintenance of the track for compartment sliding door can be performed above the fixed plate 21, and thus the daily maintenance is greatly facilitated.

Figure 7:
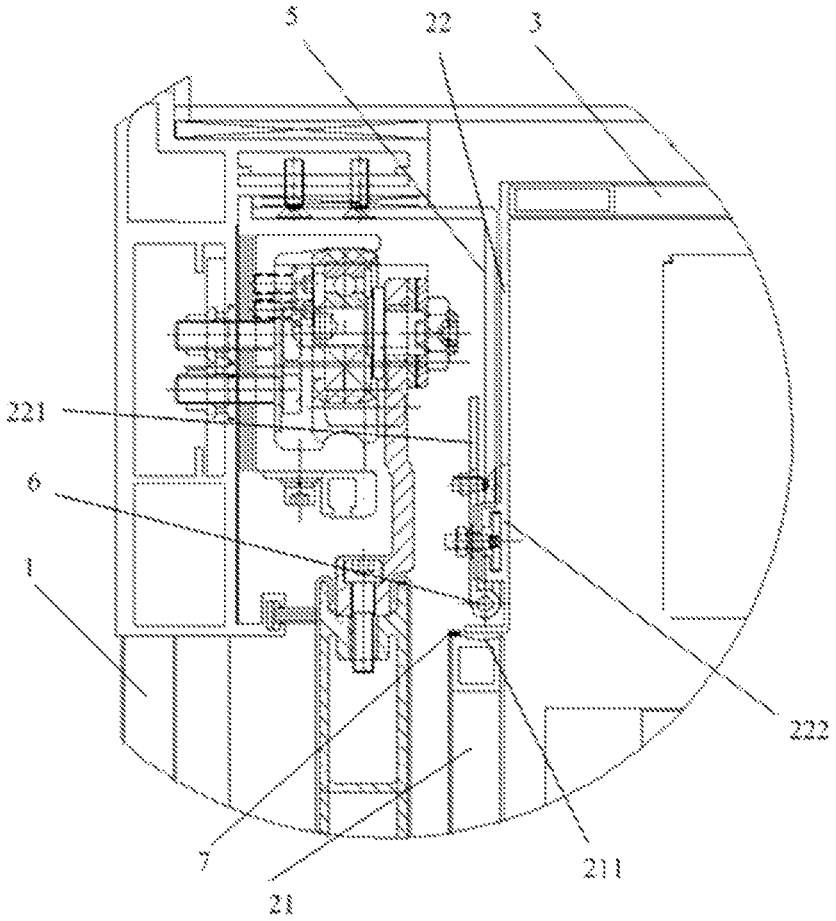
FIG. 7 is a partial enlarged view of part I of FIG. 6.

In further, the manner in which the movable panel 22 is hinged to the train body can be that a fixing bracket 5 fixedly connected to a top of the train body is provided between the compartment-side partition wall 1 and the aisle-side partition wall 2, and the lower end of the movable plate 22 is hinged to the fixing bracket 5. Specifically, FIG. 7 is a partial enlarged view of part I of FIG. 6, please refer to FIG. 7, and the fixing bracket 5 includes a horizontal section and a vertical section, where the horizontal section is used to be fixedly connected to the top of the train body to provide necessary support for the bracket. The present embodiment is not limited to a specific connection manner, for example, the connection can be performed by riveting or bolting, the lower end of the vertical section and the movable plate are hinged together by a hinge device, so that the movable plate can be rotated around the hinge point.

In further, please continue to refer to FIG. 7, the above-mentioned hinge device is provided on the movable plate 22, and includes a rotating shaft fixing portion 221 and a rotating shaft connection portion 222, and a rotating shaft 6 which penetrates through the rotating shaft fixing portion 221 and the rotating shaft connection portion 222. Specifically, the rotating shaft fixing portion 221 is fixedly connected to the vertical section of the fixing bracket 5 through a fixing bolt, the rotating shaft 6 is provided along the length direction of the train body, the rotating shaft connection portion 222 is sleeved on the rotating shaft 6, and the rotating shaft connection portion 222 is fixedly connected to the movable plate 22 so that the movable plate 22 can be rotated around the rotating shaft 6 through the rotating shaft connection portion 222.

In the actual installation operation, not only the convenience of daily opening, but also the overall neatness, beauty and ease of assembling should be considered, so that the gap between the movable plate 22 and the fixed plate 21 will not be exposed to passengers walking in the aisle 101. Therefore, in the present embodiment, the vertical distance between the movable plate 22 and the fixed plate 21 should be able to ensure that the movable plate 22 can rotate normally. In addition, a certain horizontal offset distance can be set between the movable plate 22 and the fixed plate 21 so that the movable plate 22 is closer to the aisle 101. In this way, even if the passenger looks up when walking in the aisle 101, it is difficult to find the gap between the movable plate 22 and the fixed plate 21, making the entire aisle look more beautiful.

Preferably, in order that the lower end of the movable plate 22 can smoothly rotate around the rotating shaft 6, a groove 211 extending along the length direction of the train body is provided above the upper end of the fixed plate 21 so that the movable plate 22 does not collide with the fixed plate 21 during its rotation.

Specifically, in order to meet the needs of the overall setting, the height of the fixed plate 21 is greater than or equal to the height of the compartment sliding door so that the design of the compartment sliding door is not affected. The specific height of the fixed plate 21 can be set according to needs, but it should not be much higher than that of the track for compartment sliding door for facilitating the maintenance of the track.

In further, in order to ensure a quiet and comfortable environment in the compartment 100, a rubber sealing strip 7 is provided between the fixed plate 21 and the movable plate 22. The rubber sealing strip 7 and the groove 211 are both disposed on the top of the fixed plate 21, and the rubber sealing strip 7 is disposed near the side of the compartment 100.

Figure 8:
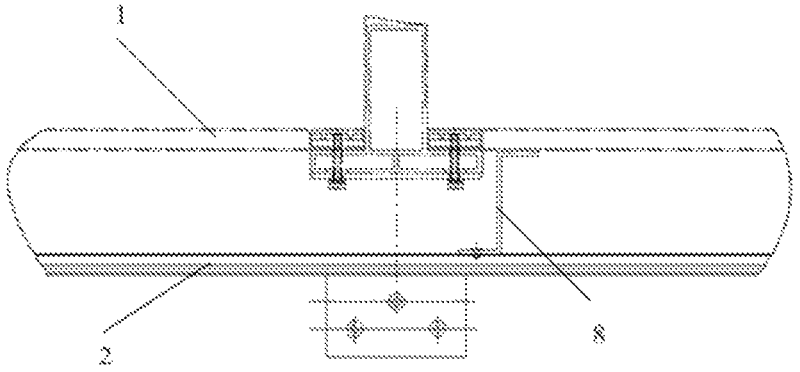
FIG. 8 is a G-G sectional view of FIG. 6.

FIG. 8 is a G-G sectional view of FIG. 6. Please refer to FIG. 8, in further, in order to meet the requirements of strength, a reinforcing rib 8 can be provided between the compartment-side partition wall 1 and the aisle-side partition wall 2. The setting direction of the reinforcing rib 8 is not limited in the present embodiment, and it can be set vertically or horizontally. Specifically, the reinforcing rib 8 may be in the form shown in the drawings, that is, one end of the reinforcing rib 8 is fixedly connected to the compartment-side partition wall 1, and the other end thereof is fixedly connected to the aisle-side partition wall 2. The connection manner thereof can be that one end of the reinforcing rib 8 is welded to the compartment-side partition wall 1, and the other end of the reinforcing rib 8 is riveted to the aisle-side partition wall 2, but the present disclosure is not limited thereto.

Figure 9:
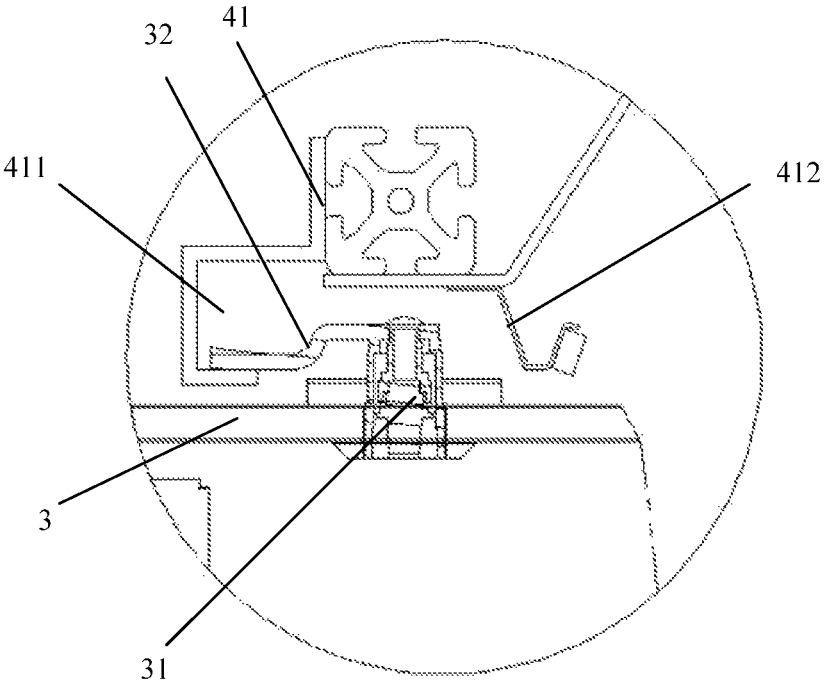
FIG. 9 is a partial enlarged view of part II of FIG. 6.

FIG. 9 is a partial enlarged view of part II of FIG. 6. Please refer to FIG. 9, in the present embodiment, the detachable connection manner of the top plate of aisle 3 and the side wall 4 of the train body can be a clamping connection. Specifically, a clamping element 41 can be fixedly connected to the side wall 4 of the train body, the clamping element 41 is provided with a clamping groove 411, the top plate of aisle 3 is provided with a lock catch, the lock catch includes a lock body 31 and a lock tongue 32 which is rotatable about the lock body 31. In the locked state, the lock tongue 31 is located within the clamping groove 411, so that the top plate of the aisle 3 and the side wall 4 of the train body is clamped and fixed. In daily maintenance, just rotate the lock body 31 to drive the lock tongue 32 to rotate, so that the top plate of aisle 3 can be rotated, which drives the movable plate 22 to rotated around the rotating shaft 6, and then the daily maintenance of the track for compartment sliding door can be performed.

With continued reference to FIG. 9, in further, the clamping element 41 can be provided with a lamp holder mounting frame 412, and a lighting lamp is provided on the lamp holder mounting frame 412. In this way, when the top plate of aisle 3 is rotated, the circuit of the lighting lamp can be conveniently maintained, so that the choice of the lighting lamp in the sleeper train carriage can be diversified, not limited to the traditional ceiling-mounted lighting lamp that can only be installed and disassembled from the front.

Figure 10:
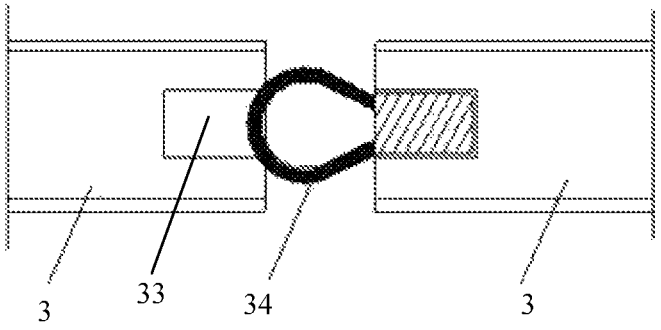
FIG. 10 is an E-E sectional view of FIG. 4.

FIG. 10 is an E-E sectional view of FIG. 4. Please refer to FIG. 10, in the present embodiment, it can be understood that the longer the length of the top plate of the aisle 3, the smaller the number of the top plate of aisle 3 for one carriage and the easier the assembling. However, the top plate of aisle 3, which is too long in the length direction, will make rotation difficult, so the top plate of aisle 3 should not be too long. The length of the top plate of aisle 3 of the present embodiment is 1.2 to 1.5 times the width of the compartment 100. Adjacent top plates of aisle 3 can be assembled using fixed or detachable connections. The present embodiment adopts a detachable connection manner, specifically, a mounting hole 33 may be provided on the top plate of the aisle 3, and the above-mentioned mounting hole 33 is filled with a sealing strip 34, so that the adjacent top plates 3 of the aisle are closely connected.

Another embodiment of the present disclosure also provides a sleeper train which includes the above mentioned sleeper train carriage.

In the sleeper train provided by the present embodiment, the partition wall is set as the compartment-side partition wall 1 and the aisle-side partition wall 2, and the aisle-side partition wall 2 includes the fixed plate 21 and the movable plate 22 which are arranged in the vertical direction, the movable plate 22 is located above the fixed plate 21, the upper end of the movable plate 22 is fixedly connected to one end of the top plate of aisle 3, the other end of the top plate of aisle 3 is detachably connected to the side wall 4 of the train body, and the lower end of the movable plate 22 is hinged to the train body, so that the movable plate 22 and the top plate of aisle 3 can rotate together around the hinged point, and during daily maintenance, the top plate of aisle 3 and the movable plate 22, which are fixed integrally, can be rotated to expose the track for compartment sliding door between the compartment-side partition wall 1 and the aisle-side partition wall 2, so that the daily maintenance of the track for compartment sliding door can be performed above the fixed plate 21, and thus the daily maintenance is greatly facilitated.

Finally, it should be noted that the above embodiments are only used to describe the technical solutions of the present disclosure, but not limited thereto. Although the present disclosure has been described in detail with reference to the foregoing embodiments, those of ordinary skill in the art should understand: the technical solutions described in the foregoing embodiments can still be modified, or some or all technical features can be replaced equivalently, and these modifications or replacements do not make the essence of the corresponding technical solution out of the scope of the technical solutions of the embodiments of the present disclosure.

What is claimed is:

1. A sleeper train carriage, comprising a side wall extending along a length direction of a train body and end walls arranged at a front end and a rear end of the side wall, wherein the side wall and the end walls jointly form a carriage body for accommodating passengers; compartments and an aisle are provided within the carriage body, and a partition wall is provided between the compartments and the aisle, wherein the partition wall comprises a compartment-side partition wall and an aisle-side partition wall, wherein the aisle-side partition wall comprises a fixed plate and a movable plate which are arranged in a vertical direction, the movable plate is located above the fixed plate, an upper end of the movable plate is fixedly connected to one end of a top plate of aisle, the other end of the top plate of aisle is detachably connected to the side wall of the train body, and a lower end of the movable plate is hinged to the train body, so that the movable plate and the top plate of aisle rotate together around a hinged point.

2. The sleeper train carriage according to claim 1, wherein a fixing bracket fixedly connected to a top of the train body is provided between the compartment-side partition wall and the aisle-side partition wall, and the lower end of the movable plate is hinged to the fixing bracket.

3. A sleeper train, comprising the sleeper train carriage according to claim 2.

4. The sleeper train carriage according to claim 2, wherein the movable plate is provided with a rotating shaft fixing portion and a rotating shaft connection portion, a rotating shaft penetrates through the rotating shaft fixing portion and the rotating shaft connection portion, and the rotating shaft fixing portion is connected to the fixing bracket through a fixing bolt.

5. A sleeper train, comprising the sleeper train carriage according to claim 4.

6. The sleeper train carriage according to claim 4, wherein an upper end of the fixed plate is provided with a groove extending along the length direction of the train body.

7. A sleeper train, comprising the sleeper train carriage according to claim 6.

8. The sleeper train carriage according to claim 1, wherein a rubber sealing strip is provided between the fixed plate and the movable plate.

9. A sleeper train, comprising the sleeper train carriage according to claim 8.

10. The sleeper train carriage according to claim 1, wherein a reinforcing rib is provided between the compartment-side partition wall and the aisle-side partition wall.

11. A sleeper train, comprising the sleeper train carriage according to claim 10.

12. The sleeper train carriage according to claim 1, wherein a clamping element is fixedly connected to the side wall of the train body, the clamping element comprises a clamping groove, the top plate of aisle is provided with a lock catch, the lock catch comprises a lock body and a lock tongue which is rotatable about the lock body, and in a locked state, the lock tongue is located in the clamping groove.

13. The sleeper train carriage according to claim 12, wherein the clamping element is provided with a lamp holder mounting frame, and the lamp holder mounting frame is provided with a lighting lamp.

14. A sleeper train, comprising the sleeper train carriage according to claim 13.

15. A sleeper train, comprising the sleeper train carriage according to claim 12.

16. A sleeper train, comprising the sleeper train carriage according to claim 1.

* * * * *